United States Patent [19]

Wilkerson

[11] 4,085,918

[45] Apr. 25, 1978

[54] COMPOSITE CONSTRUCTION FORM SYSTEM

[76] Inventor: Joseph Felton Wilkerson, Rte. 2, Roxboro, N.C. 27573

[21] Appl. No.: 723,495

[22] Filed: Sep. 15, 1976

[51] Int. Cl.[2] ..... B28B 7/30; B28B 7/16; E02D 29/10

[52] U.S. Cl. ..... 249/11; 249/149; 249/177; 249/179; 249/184

[58] Field of Search ..... 249/11, 12, 144, 145, 249/209, 211, 26, 27, 152, 154, 155, 184, 185, 210, 212, 205, 49, DIG. 4, 121, 132, 139, 143, 170, 188, 194, 211, 137, 179, 177, 153, 21, 23, 48, 51, 65, 69, 92, 166, 149, 24, 25, 91, 93, 95; 264/112

[56] References Cited

U.S. PATENT DOCUMENTS

| | | | |
|---|---|---|---|
| 405,652 | 6/1889 | Baade | 249/185 |
| 875,551 | 12/1907 | McDonald | 249/185 X |
| 1,049,352 | 1/1913 | Fleming | 249/168 |
| 1,850,463 | 3/1932 | Kleczewski | 249/168 |
| 2,635,320 | 4/1953 | Ornitz | 249/34 X |
| 2,704,875 | 3/1955 | Kingston | 249/145 |
| 2,929,125 | 3/1960 | McGinnis | 249/185 |
| 3,123,885 | 3/1964 | Marler | 249/139 |
| 3,227,788 | 1/1966 | Loper | 264/112 |
| 3,570,801 | 3/1971 | Moritz | 249/166 X |

*Primary Examiner*—Francis S. Husar
*Assistant Examiner*—John S. Brown
*Attorney, Agent, or Firm*—Mills & Coats

[57] ABSTRACT

In abstract, a preferred embodiment of this invention is a multi-purpose form system for use in culverts, manholes and other locations. A basic semi-cylindrical form is provided for use in combination with other types of forms to give a complete system for accomplishing the results intended.

6 Claims, 7 Drawing Figures

COMPOSITE CONSTRUCTION FORM SYSTEM

This invention relates to building materials and more particularly to multi-purpose, adjustable readily removable forms for use with concrete of other setable substances.

Although over the years a number of different types of removable forms have been disclosed for use in conjunction with setable materials such as concrete, none of these devices have proved satisfactory and concrete work in manholes, open culverts, and similar drainage areas are still accomplished almost exclusively by hand troweling. This is not only a laborious, time consuming job but also often gives questionable results in a finished structure. The reason for this is that the concrete being worked must be partially set or it will run back into the trough. Once it reaches the partially set condition, work must be quickly completed. Usually a multi-stage process is used whereby the desired configuration is partially formed and then over a period of hours refined as the concrete sets further until the job is finally considered completed or the concrete sets to the point that nothing further can be done. Quite often this leads to a roughly finished job which on many occasions will not pass the Building Inspector's inspection and must be removed with air hammers and redone. The hand method of troweling the bottoms of manholes and culverts additionally does not allow precision leveling since usually the labor involved is relatively low skilled and the hand troweling is inaccurate at best. Even under ideal conditions with relatively skilled labor it takes a workman an entire work day to complete a medium size manhole drain. If a number of lines are entering or exiting from the manhole, the system may have to be poured in two or more steps which requires additional days to complete.

After much research and study into the above mentioned problems, an improved form has been developed which is versatile in that it can be used in a plurality of enivornments and can be used in several multi-configurations as needed. The present invention allows accurate prealigning of level and direction with unskilled labor being able to complete the job in better and in less time than heretofore was possible using skilled labor.

In view of the above, it is an object of the present invention to provide a form for setable materials which is versatile to use and simple to remove.

Another object of the present invention is to provide a form for manhole type drains which is adapted to accommodate three or more flow directions.

Another object of the present invention is to provide a manhole in conduit form which prevents undesired setable material from entering the interior of the form.

Another object of the present invention is to provide, in a manhole conduit form, a means for pouring a setable material in one area while a flow of fluid is allowed to continue to run in another adjacent area.

An even further object of the present invention is to provide in a setable material form, a means for steadying the form during the pouring and setting of material.

An even further object of the present invention is to provide, in a form for setable material, a cover to prevent undesirable material from entering the interior of the form in combination with means for securing the cover to prevent undesired movement.

Another object of the present invention is to provide, in a form for a setable material, a cover means which is so shaped as to act as a workman's platform as well as a means for preventing flowable material from entering the interior of the form.

Other objects and advantages of the present invention will become apparent and obvious from a study of the following description and the accompanying drawings which are merely illustrative of such invention.

IN THE DRAWINGS

Figure 1:
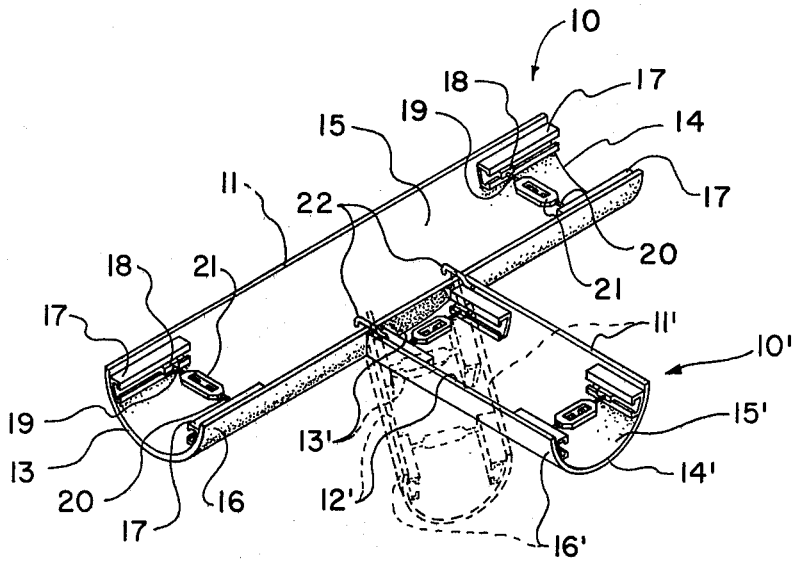
FIG. 1 is a top perspective view of the straight and T portions of the present invention.

With further reference to the drawings, an elongated semi-cylindrical member indicated generally at 10 is provided and is composed of a relatively stiff and yet deformable material. This form includes edges 11 and 12, ends 13 and 14 and has an interior 15 and an exterior 16.

Track or stringers 17 are disposed longitudinally on and fixed to the interior surface 15 of form 10 adjacent each of the edges 11 and 12 and ends 13 and 14 as seen in the drawings.

A removable slide 18 is adapted to slidingly engage each of the tracks 17. Opposed slides 18 are adapted to releasably engage oppositely threaded rods 19 and 20. Although other methods could be used, a 90° bend in the end of each of the rods 19 and 20 and adapted to pass through an opening in its respective slide 18 has been found to work well. A turnbuckle portion 21 is adapted to threadingly engage each oppositely disposed set of threaded rods 19 and 20 in the normal manner for such devices. Since the operation of turnbuckles is well known to those skilled in the art, further discussion of the same is not deemed necessary.

Since junctures of two or more drains are common in the installation of culverts, man holes, and similar drainage systems, a second semi-cylindrical form 10' is provided. The turnbuckles, tracks, slides, etc., are all substantially the same as that hereinabove described for form 10 except one end of form 10' is concave to conform to the exterior 16 of form 10 as seen in FIG. 1. The other difference in form 10' and form 10 is a pair of hooks 22 which are provided on each of the edges 11' and 12' adjacent concave end 13'. The purpose of these elongated hooks is to support form 10' in proper relationship with form 10 when the two forms are used together.

Figure 2:
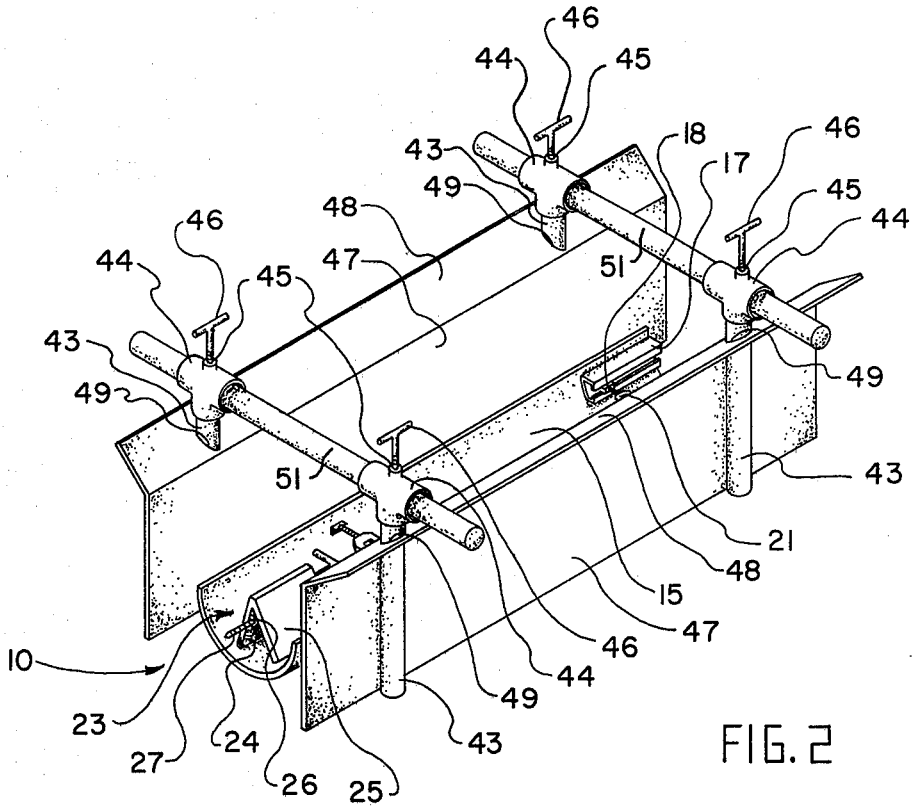
FIG. 2 is a top perspective view of the straight form with locking lug and dam partitions disposed adjacent thereto.
Figure 6:
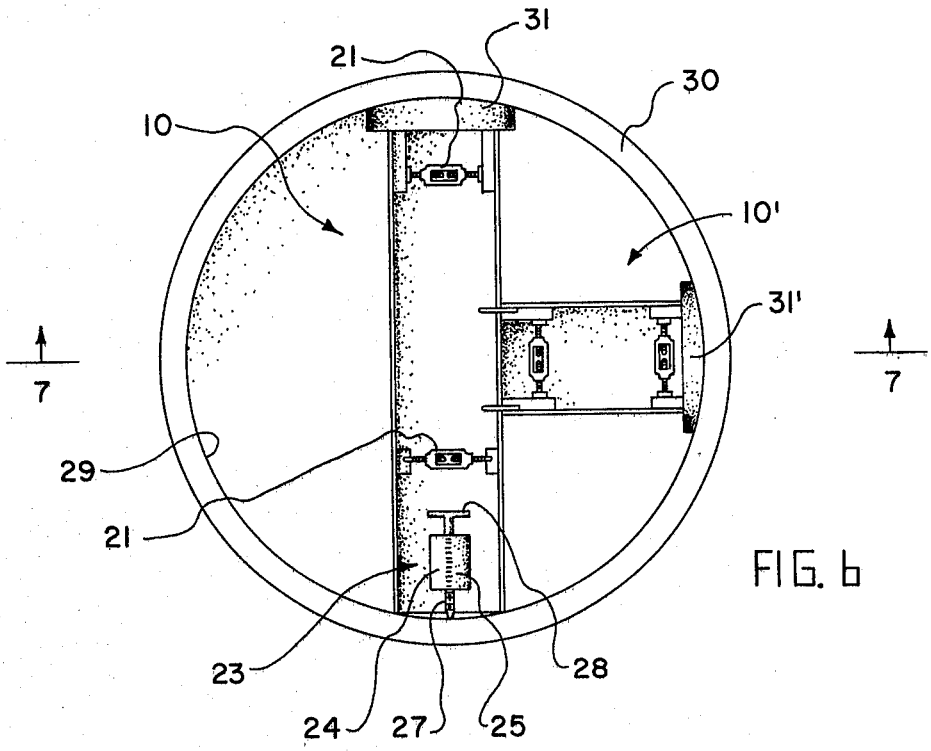
FIG. 6 is a top plan view of a typical manhole installation using the form system of the present invention.
Figure 7:
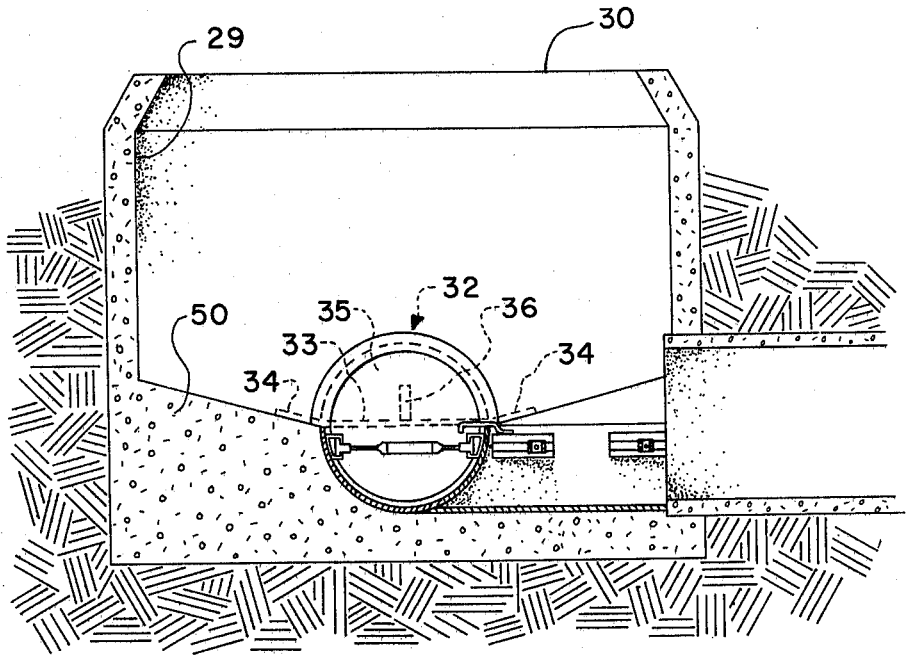
FIG. 7 is a sectional view taken through lines 7—7 of FIG. 6.

Form 10 shown in FIGS. 2, 6 and 7 includes a form blocking or steadying means indicated generally at 23. This means is preferably in the form of a pair of plates 24 and 25 fixedly secured to the center interior 15 of form 10 adjacent one end and so disposed to form an inverted V-shape in cross section. At least one nut-like threaded member 26 is fixedly secured between plates 24 and 25 and the threaded portion 27 of T-shaped locking pin 28 threadingly engages the same.

As can clearly be seen in the plan sectional view of a typical manhole in FIG. 6, the end of pin 28 engages the interior wall 29 of manhole 30 and the other end of form 10 engages one of the pipes 31 emptying into or exiting from such manhole.

Figure 3:
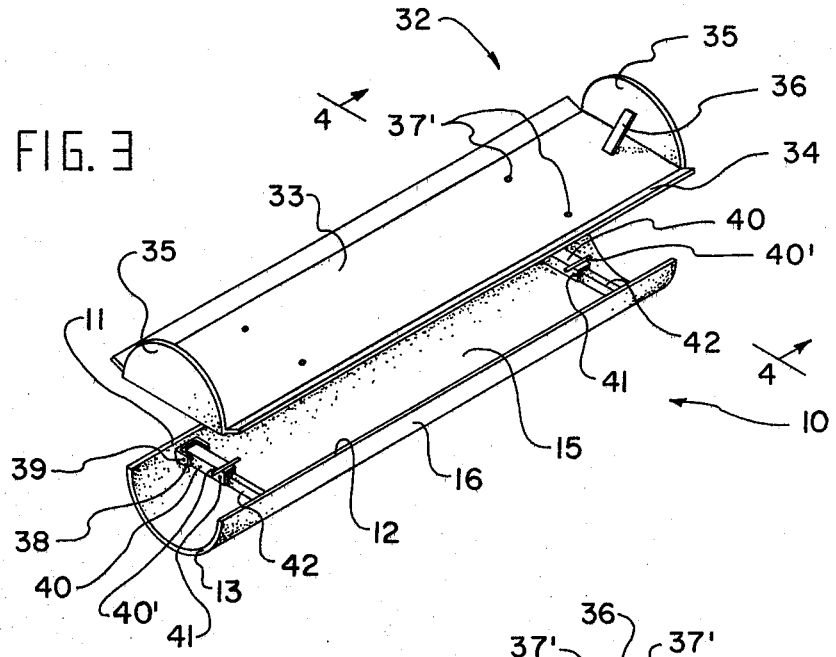
FIG. 3 is a top perspective view of a modification of the straight form with the protective cover in exploded relation thereto.

A cover 32 such as that shown in FIG. 3 can be provided for use with each of the forms 10. This cover is preferably in the form of a generally flat platform area 33 with slightly upturned longitudinal edges 34. The ends 35 of cover 32 are preferably disposed at 90° to platform 33, are semi-cylindrical in shape and include reenforcing braces 36. The reason for this configuration is so that when the cover 32 is placed on form 10 in the use position shown in FIG. 6, one of the upturned semi-cylindrical end portions will be butted juxtaposed to the end of pipe 31 to prevent concrete from entering the same when it is poured around the form. Also, the platform portion 33 of cover 32 can be used for workmen to stand on while smoothing out or otherwise working the freshly poured concrete. The upturned edges 34 of cover 32 are to coincide with the usual angle of drains as seen clearly in FIG. 7.

Figure 4:
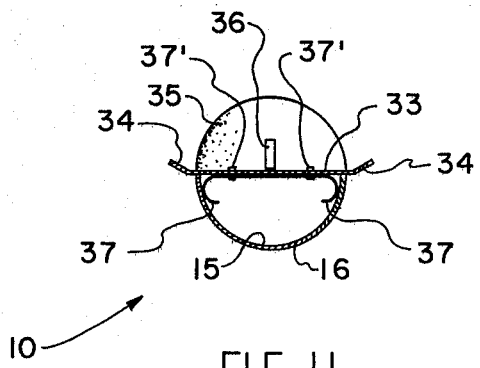
FIG. 4 is a sectional view of the form cover in place.

Since cover 32 would normally tend to shift if simply lying on top of form 10, particularly during the pouring of concrete around such form, centering and retaining members 37 are provided. These are preferably generally C-shaped as shown in FIG. 4 and can be fixedly secured to the lower side of platform portion 33 by means such as rivets or screws 38. These centering and retaining means are preferably made from spring steel type material so that they can adapt to slight variations in the width across the form mouth and yet engage the same snugly at all times.

Figure 5:
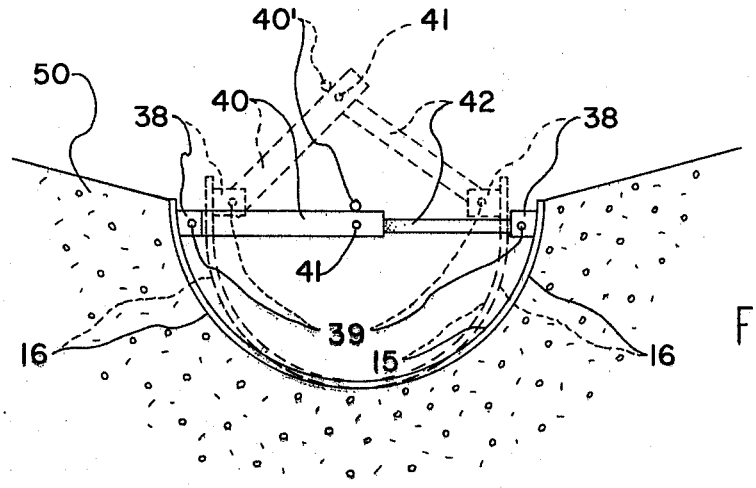
FIG. 5 is a sectional view of the modified form in use position.

The quick release means shown in FIGS. 3 and 5 comprises a U-shaped bracket 38 secured on opposite sides of the interior 15 of form 10. A pin 39 is associated with each of the brackets 38. A channel-like member 40 is provided and is pivoted at one end to its respective pin 39 and is pivotably secured by pin 41 to member 42. The end of member 42 opposite pin 41 is pivotably mounted on its own bracket pin 39. A handle 43 is fixedly secured to channel member 40 to aid in breaking the pivot between members 40 and 42 as shown in FIG. 5 to release the form from the hardened concrete.

The turnbuckle modification first above described of course releases the form 10 in the same manner as the pivoted member release.

As often happens in the construction of drain systems, while one drain is being repaired or constructed, an adjacent area is carrying a flow of liquid. In the past, this liquid flow has eroded the concrete of the drain being poured and temporary coffer dams had to be devised. Since these are custom systems they are time consuming, laborious and relatively skilled effort has had to be put forth. This not only slows the construction project but also adds greatly to its cost. For use in association with the forms of the present invention, a readily adjustable and variable system has been developed for use with one or more coffer dams to allow water control on one side and concrete to set on the other. A double dam form is shown in FIG. 2 although obviously one could be removed if not needed or a third or fourth could be added as necessary.

The coffer dam system of the present invention includes at least four leg-like members 43 terminating in a T-joint configuration 44. Each of these T-joints includes a threaded opening 45 communicating into the interior thereof. A T-shaped locking screw 46 threaded on one end is adapted for use in each of the threaded openings 45 in the same manner as a set screw. An elongated rod or pipe 47 is passed through opposite pairs of T-joints as clearly illustrated in FIG. 2 and are locked in place by locking screw 46. A generally flat coffer dam 47 includes an angular break 48 along one edge which has at least two openings 49 therein. Either one or two dams 48 can be used (or more if desired) depending on the requirements of the drainage system being formed up. Obviously through use of locking members 46, lateral adjustments in the distance between the dam forms can readily be accomplished. When the form has been left in place for an adeqaute length of time for set and is ready to be removed, locking members 46 can be released and the entire structure hereinabove described can be removed and disassembled for transportation or storage.

To use the form system of the present invention, the tension is released on either the turnbuckles or quick release modification of the form 10 and it is placed in the desired location of the normal manner. If a manhole is being prepared, the steadying means 23 can be tightened down by turning handle 28 so that the end of threaded portion 27 engages the inner wall 29 of the manhole 30 as seen particularly clear in FIG. 6. This presses the end opposite steadying means 23 against pipe 31 to rigidly lock the form in place. If a second drainage pipe such as that illustrated at 31′ is involved, the form 10′ can be used by placing hooks 22 over the edge 12 of form 10. Once the forms are in proper location, cover 32 can be placed over form 10.

Concrete or other suitable material can be poured around the forms to the desired height. A workman (not shown) can then stand on platform 33 of cover 32 and with trowels or other working instruments level the concrete and work the same as desired.

Once the concrete has set up, cover 32 can be removed and either the quick release mechanism of FIG. 5 raised or the turn buckle configuration of FIG. 1 turned. In any case, the form will be deformed as shown in FIG. 5 thus breaking the exterior 16 loose from the set material or concrete 50.

The form can then be very easily removed from its former location thus leaving the desired drainage depression in the concrete. Form 10′ can be likewise used and removed as hereinabove described for form 10.

As heretofore mentioned, should it be desirable or necessary to pour concrete in an area where either a constant or intimiate flow of liquid is necessary or desirable, the dam assembly of FIG. 2 can be used in conjunction with the form of the present invention. The form is set up by placing legs 43 in the proper location, passing rod 51 through T-joints 44 and secure the same therein by tightening of set screw 46. The generally flat coffer dam can be put in proper position and legs 43 passed through openings 49 of flange portion 48 to give proper steadying to dam 47. The dam 47 can be disposed either adjacent legs 43 or at an angle thereto as desired. Also they can be reversed from the position shown in FIG. 2 if the form is used on the outside rather than therebetween. Additionally, only one dam need be used or more than two can be added to rod 51 by adding additional T-joints and associated legs.

From the above, it can be seen that a combination of the various parts of the present invention provide a composite system for producing drainage depressions and similar structures with a minimum of labor and effort and in a minimum period of time.

It is obvious that the present invention has the advantage of providing a relatively inexpensive and yet highly efficient system of forms which will accomplish a multiplicity of purposes, the sum of which is greater than either one by itself.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

I claim:

1. A system of forms for use with concrete and other setable materials comprising: a first relatively thin walled, semi-cylindrical form means having two open end portions and being elongated so as to define a longitudinal axis through said form means, an open side and two edges adjacent such side; means secured adjacent and extending between opposite edges across said open side for drawing said edges toward each other; a generally flat cover means removably enclosing said open side of said form; means for releasably retaining said cover means relative to said form means; and an adjustable anchoring means connected to said form means adjacent one of said open end portions and movable in a direction generally parallel to said longitudinal axis for steadying said form means during the pouring of setable material whereby an improved form system is provided.

2. The form system of claim 1 including a second relatively thin walled, elongated, semi-cylindrical form means of similar structure to said first form means and having one end so shaped as to conform to at least a portion of the exterior of said first form means disposed generally perpendicular thereto with said edges of both said first and said second form means lying generally in the same plane.

3. The form system of claim 2 including means integral with said second form means supporting the same juxtaposed to said first form means.

4. The form system of claim 3 wherein the supporting means are hooks secured to the edges of said second form.

5. The form system of claim 1 wherein said cover means includes generally parallely disposed upturned edges on opposite sides of said cover whereby the setable material can more easily be worked and formed.

6. The form system of claim 1 wherein an adjustable coffer dam means is provided for use adjacent said form means, said coffer dam disposed outside of said form means and including two laterally spaced walls extending in parallel relationship to the longitudinal axis of said form means such that said form means extends generally between said coffer dam.

* * * * *